United States Patent [19]

Aubert

[11] 3,938,342

[45] *Feb. 17, 1976

[54] METHOD AND A DEVICE FOR BUILDING IMMERSED FOUNDATIONS

[76] Inventor: Jean Aubert, 8 rue la Boetié, Paris 8, (Seine), France

[ * ] Notice: The portion of the term of this patent subsequent to Mar. 13, 1990, has been disclaimed.

[22] Filed: June 4, 1973

[21] Appl. No.: 366,354

[52] U.S. Cl. ..... 61/46; 61/49; 61/50

[51] Int. Cl.[2] ..... E02B 3/06; E02B 7/00

[58] Field of Search ..... 61/50, 52, 46, 49

[56] References Cited

UNITED STATES PATENTS

| | | | |
|---|---|---|---|
| 1,076,743 | 10/1913 | Butler | 61/50 |
| 2,622,404 | 12/1952 | Rice | 61/465 |
| 3,683,632 | 8/1972 | van der Veen | 61/50 |
| 3,720,067 | 3/1973 | Aubert | 61/52 X |

*Primary Examiner*—Jacob Shapiro
*Attorney, Agent, or Firm*—Young & Thompson

[57] ABSTRACT

In a method for building immersed foundations on a prepared bed without preliminary unwatering by means of a platform which is intended to support the final structure, the steps which consist in positioning in the underwater bed a support having at least three bearing points which are so adjusted as to project from the bed to a height corresponding to the intended depth of the seating plane, in lowering the platform onto the bearing points, in placing a hardenable material such as concrete or mortar on the foundation bed so as to imprison at least the lower ends of anchoring means which extend downwards from the platform.

17 Claims, 8 Drawing Figures

METHOD AND A DEVICE FOR BUILDING IMMERSED FOUNDATIONS

This invention relates to a method for the construction of immersed foundations on a prepared bed without preliminary unwatering. Foundations of this type can serve in particular to support a civil engineering structure having an underwater foundation, such as a bridge pier, a quay wall, a fixed or movable dam, a hydroelectric power station and the like. The invention is also directed to a device for carrying out said method.

Methods and devices for building immersed structures on a prepared bed without preliminary unwatering are already known. Constructional arrangements of this type have been described, for example, in French Pat. No. 70 14 426 and in the first French Certificate of Addition No. 71 10 508.

The known method which has just been referred-to involves immersion of a platform constituting the cover of an enclosed space in which the vertical side walls are constituted at least to a partial extent by walls of metallic sheet piles which have previously been driven into the ground. The enclosed space thus defined is then filled by placing in position a material in the plastic state which is capable of setting; but in order to prevent the cover from being lifted as a result of the filling operation which can be completed only by injecting the plastic material at the pressure which is necessary to fill the empty spaces, steps are taken beforehand to anchor the platform by means of suitable devices. The preparation of these devices prior to sinking of the platform followed by the arrangement of the anchoring members entail costly operations since they require the services of frogmen. During the sinking operation, the platform must also be brought to an accurately defined position in plan, as otherwise the arrangement of the anchoring members would not be possible.

The object of the present invention is to solve these difficulties by making it possible to build immersed foundations without preliminary unwatering by means of a cover which can readily be sunk to a perfectly defined depth.

In accordance with the invention, the method for building immersed foundations on a prepared bed without preliminary unwatering by means of a platform which serves as a cover for the hardenable material such as the concrete employed in the construction of the foundation and which defines a seating surface for the final structure, is characterized in that it entails the following steps:

a support constituted by at least three bearing points which project from the underwater bed is placed in position on said bed;

the height of the bearing points is adjusted as a function of the depth selected for the seating plane;

the platform is lowered underwater so as to rest on the bearing points, the underface of the platform being provided with downwardly extending anchoring means;

a plastic material which is capable of setting and hardening such as concrete or mortar is placed on the foundation bed in a sufficient quantity to ensure that the platform anchoring means are imprisoned therein, at least at the lower ends thereof.

Since the bearing points are ajusted for height prior to positioning of the platform, this latter is therefore placed directly at the desired depth. The platform is then firmly secured by the anchoring means embedded in the mass of hardened material which rests on the foundation bed. Since they are only required to carry the weight of the platform and even then only temporarily, the bearing points can be few in number and of moderate strength. Furthermore, it is unnecessary to attach the platform to the support which is constituted by the bearing points.

In one preferred mode of execution of the invention, the support is constituted by elongated elements such as posts, piles or sheet piles which are driven down to the requisite depth. The extent of downward projection of the platform anchoring means is smaller than the height of the bearing points above the foundation bed. The interval between the bed and the periphery of the platform which, in this preferred mode of execution, is already reduced by a downwardly directed flange, is closed by an embankment of filling material such as sand or gravel. After hardening of the first mass of plastic material which is placed under low pressure in order to guard against uplift of the cover, a plastic material is again injected between the platform and the mass which has already hardened. For this second operation, it is found preferable to employ a plastic material having a higher degree of fluidity in order that it should penetrate into the small spaces. To this end, the operation is carried out at a higher pressure than the pressure employed during the first operation. This increase in pressure is not liable to cause uplift of the cover although it does have a tendency to displace the platform from the mass which has already hardened. In fact, such a displacement is completely prevented by the presence of the anchoring means, the upper ends of which are attached to the platform and the lower ends of which are imprisoned in the previously hardened mass which rests on the foundation bed.

There is thus provided a simple and economical method of building foundations which are set at a precise depth and offer a high degree of strength.

It is in fact possible to carry out the final injection under conditions such that the injected material comes into contact with the underface of the steel plate at least over a large part of the surface of this latter in order that, after setting and ultimate hardening, the weight of the final construction which will subsequently be carried on the top face of said steel plate can be transmitted directly by this latter to the subjacent material and through said material to the ground.

A compact mass consisting of metal and concrete can thus be formed for the foundation of the final structure and is comparable with a reinforced concrete slab which rests on the ground. Said mass can be consolidated beforehand if necessary by one of the known methods and the top face of the mass is located very precisely at the predetermined depth.

In a preferred embodiment, there is selected a plastic material which is immiscible with water.

The device in accordance with the invention for the practical application of the method aforesaid is characterized in that it comprises:

a support having at least three bearing points, the height of which can be adjusted with respect to the foundation bed and has been set to correspond to a seating plane;

a platform which rests on said bearing points and is provided on the underface thereof with downwardly extending anchoring elements;

means for closing the space between the foundation bed and the periphery of the platform;

means for pouring a hardenable material such as concrete between the platform and the bed in order to embed the anchoring means in the hardenable material.

Accurate height-positioning of the platform and anchoring of this latter in the ground or foundation bed can readily be ensured without any attendant hazard by the means which are contemplated for the construction of the device according to the invention.

In a preferred embodiment of the invention, the platform support has elongated elements such as posts, piles or sheet piles. The structure of the platform comprises bracing elements which are provided so as to form a reinforced concrete foundation raft and which also serve as anchoring means. The platform constitutes a substantially leak-tight surface and has pluggable passages for the concrete and the mortar and pluggable discharge passages for water and air as well as means for injecting mortar under pressure.

There is one particular case which is worthy of special note, namely in which the upstream and downstream faces of the final structure such as a dam, for example, are intended to withstand different water pressures and in which the foundation raft is supported on a permeable bed. In that case, it is necessary to take particular precautions in order to prevent seepage paths through the ground beneath the structure. Recourse may be had to an injection shell or alternatively to the use of a metallic sheet-pile wall. In the latter instance, it is an advantage to drive a few sheet piles of the wall to a precise depth in order that these latter may perform a supporting function whilst the remainder of the wall is driven to a slightly lower depth without taking any special precautions.

Further properties and advantages of the invention will be brought out by the following description of a preferred mode of execution of the embodiment which is considered by way of example but not in any sense by way of limitation, reference being made to the accompanying drawings, in which.

Figure 1:
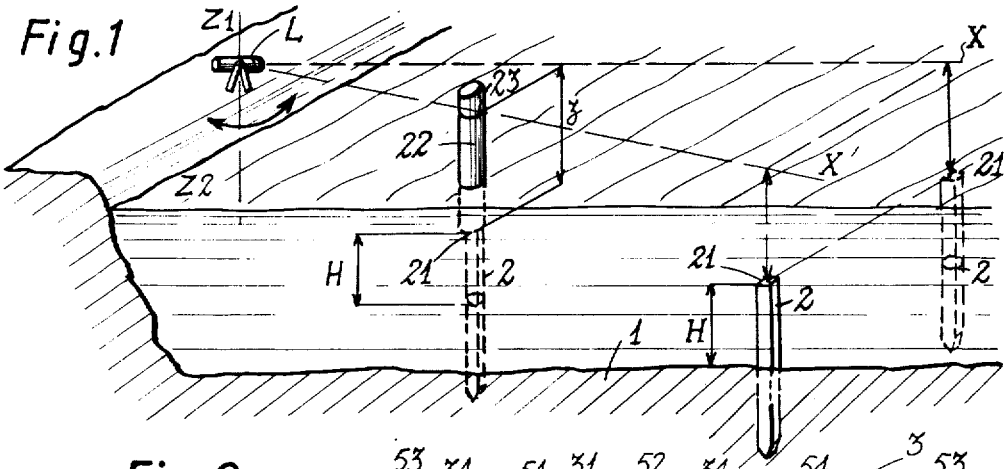
FIG. 1 is a perspective diagram showing the positioning of the support in accordance with the invention.
Figure 2:
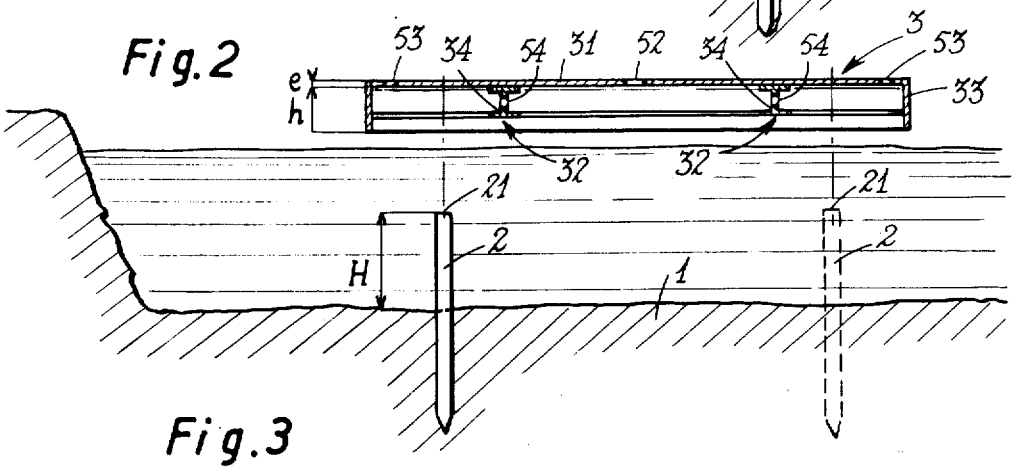
FIG. 2 is a diagrammatic sectional view showing the position of the platform in accordance with the invention on the support of FIG. 1.

In order to construct underwater foundations on the sea floor or on a river bed for a structure which is intended to have a seating plane parallel to the sighting plane LX-LX′ (as shown in FIG. 1), piles 2 are driven to the corresponding level by referring to a bench mark 23 made on a false pile and followed by a sighting telescope L having high magnification, the heads 21 of said piles being intended to constitute the bearing points of the platform 3 which serves as a cover (as shown in FIG. 2). If so required, the underwater bed or foundation floor 1 will have been freed from any projecting obstructions and roughly prepared by dredging, for example, the load-carrying stability of the floor having been increased by any known means if necessary.

The heads 21 of the piles 2 are driven to a depth $z$ with respect to the sighting plane LX-LX′ corresponding to a height H which varies from one pile to another if the bottom is not completely horizontal.

In order to ensure accuracy of this adjustment in the case of piles which are driven with a drop hammer, steps are taken to ensure that the extent of penetration is less than 1 mm per hammer stroke. By operating with care with reference to the position of the bench mark 23 which is sighted by the telescope L, the head 21 of each pile 2 can be levelled down to the desired depth with a precision of the order of 1 millimetre. The piles 2 must extend from ground level to a sufficient height to ensure that the bracing beams 34 and the side 33 of the platform 3 are not liable to come into abutment with the foundation floor at the moment of positioning of the platform 3 on the pile heads 21.

The platform 3 is placed in position by immersion on the bearing points 21 (shown in FIGS. 2 and 3) and is constituted by a steel sheet 31 having a practically negligible thickness $e$. Steel bracing beams 34 are welded to the underface of the steel sheet 31 in order to improve the rigidity of the platform 3 during transportation and positioning of this latter on the bearing points 21. The beams 34 are I-section members, the bottom flange 32 of each beam being intended to serve as a means for anchoring the platform. Said platform is also provided with a downwardly extending side 33. The extent of projection of the anchoring means 32 and of the side 33 does not exceed a value $h$ which is smaller than the minimum height H of the bearing points 21 above the foundation floor 1 (as shown in FIGS. 2 and 3).

The space existing between the side 33 and the floor 1 is then closed by means of an embankment 4. By way of example, said embankment is formed by alluvia which are dumped in position by any known means. There has thus been formed a substantially closed space between the platform 3 and the foundation floor 1.

Figure 3:
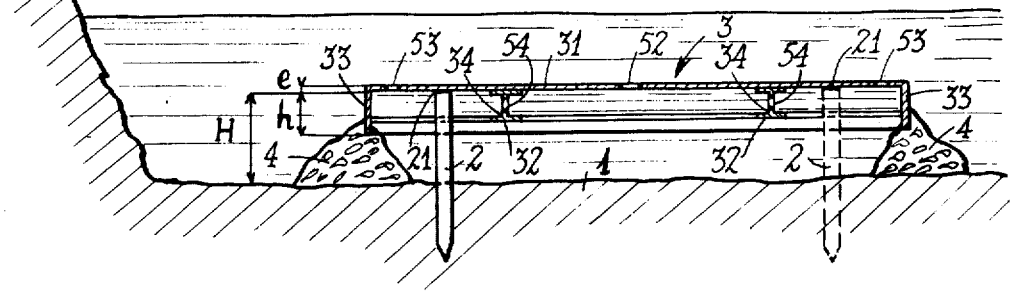
FIG. 3 shows the closure of the space between the foundation floor and the periphery of the platform.
Figure 4:
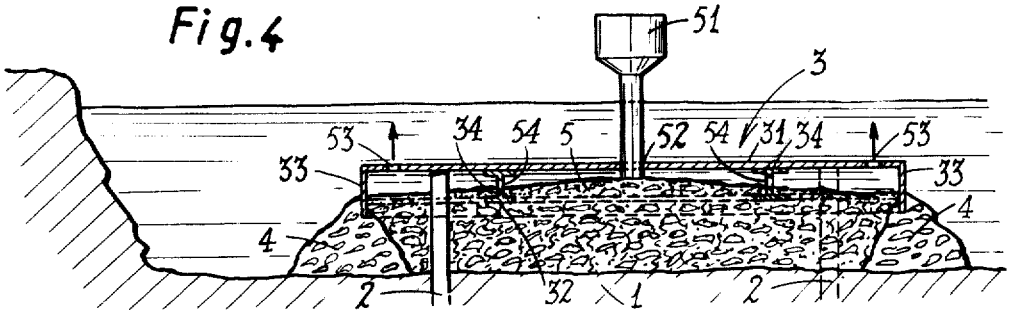
FIG. 4 shows the placing of the concrete which is intended to set on the anchoring means.
Figure 6:
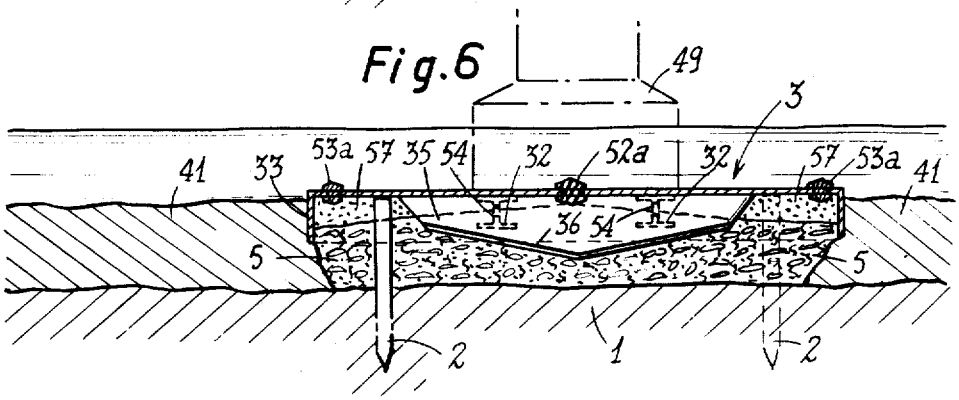
FIG. 6 shows a specially reinforced platform.

The steel sheet or plate 31 and the side 33 form a welded structure and constitute a continuous and leak-tight surface in which are formed passages 52 for the introduction of the concrete (as shown in FIGS. 3 and 4) and apertures 53 for the discharge of water and air. The apertures 53 and the passages 52 can be closed as required by means of plugs 53$a$, 52$a$ which are remotely actuated from the surface or operated by divers (FIG. 6). Outflow apertures 54 are also formed through the webs of the beams 34, thereby reducing the number of concrete-placement passages 52 and discharge apertures 53.

Introduction of the concrete 5 is carried out through the passage 52 by means of a hopper 51 (shown in FIG. 4) which is supplied at the surface by concrete-mixing means (not shown in the drawings). The concrete 5 flows under the action of gravity and spreads over the foundation floor 1 between the embankments 4. Pouring of the concrete is continued until the bottom flanges 32 of the beams 34 are embedded in the concrete. The level of the concrete can be observed through the passages 52 and through the apertures 53 which permit progressive discharge of water and air pockets. The concrete-pouring rate is regulated so as to prevent uplift and displacement of the platform 3. Pouring of the concrete 5 is stopped substantially at the level shown in FIG. 4.

Figure 5:
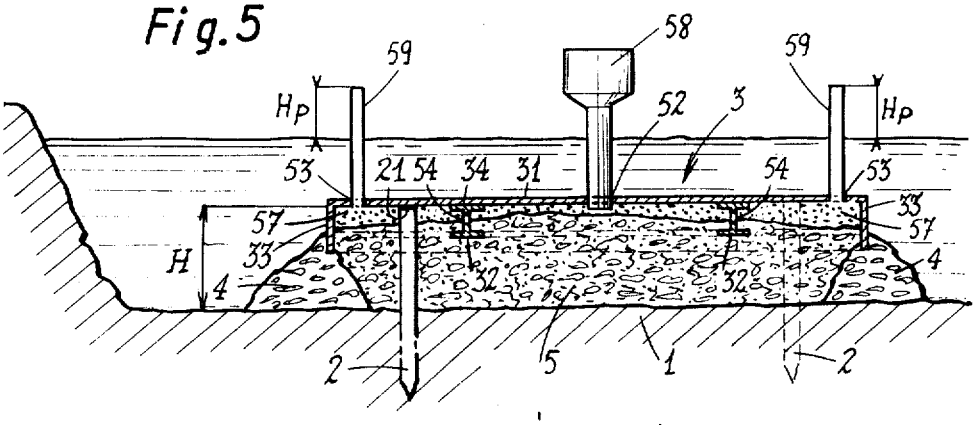
FIG. 5 shows diagrammatically the injection of concrete or grout between the platform and the mass which has already solidified.

Once the mass of concrete 5 has hardened, the platform is firmly anchored to the foundation floor by means of the flanges 32 of the beams 34 which are embedded in the concrete as shown in FIG. 5.

The structure which is constituted by the plate 31, the bracing beams 34 and the side 33 which is bonded to the monolithic block of hardened concrete 5 forms an assembly having a high degree of rigidity and in which a free space of very small depth, still filled with water together with a few air pockets in some instances, still remains between the plate 31 and the concrete block 5. Said space is made leak-tight by the side 33 and the plate 31 which is provided with a pluggable passage 52 and discharge apertures 53. The platform 3 and the concrete block therefore constitute a high-strength hollow body, the walls of which are impermeable and which remains to be filled completely by means of grout injections.

By making use of the hopper 58 which is supplied from the surface by any suitable means (not shown), the grout 57 of the mortar type immiscible with water is injected between the platform 3 and the solidified mass of concrete 5. The water and air continue to escape through the apertures 53. The pressure of injection of the grout 57 is regulated by means of tubes which are adapted to the apertures 53 and have their openings above the surface of the water. The height Hp of the upper ends of said tubes defines the value of the grout injection pressure. The effective injection pressure can be of the order of 300 millibars, for example, namely substantially 3 metres of water in respect of the height Hp.

By virtue of a pressure of this order, the entire upper portion of the concrete-placement space beneath the platform 3 can be filled with grout 57 in a very efficient manner so as to endow the foundations thus formed with high strength.

In spite of this high pressure which corresponds to an uplifting effort of 3 tons per square inch metre, the platform 3 remains motionless since it is securely anchored in the concrete block 5 by means of the flanges 32. It is readily apparent that the strength and resistance of all the constituent elements under a pressure of this order are determined by stress analysis.

The strength of the foundations which are constructed as described in the foregoing can be improved even further by introducing the grout or mortar 57 a number of times with a sufficient interval between injections to ensure that the mortar hardens completely, and by operating with increasing pressures.

When injections of the grout 57 is completed (as shown in FIGS. 5 and 6) the concrete-placement and injection passage 52 and the discharge apertures 53 can be closed by means of plugs 52*a*, 53*a*.

A number of important advantages are provided by the invention as can be seen from the foregoing description.

The vertical position of the platform which rests on the bearing points 21 can readily be adjusted with a precision of the order of 1 millimeter by virtue of the present invention. It is apparent that the seating plane defined by the plate 31 can be set exactly in a horizontal position or at a given angle of slope, for example for the foundations of a dam.

The operation involved in positioning the platform 3 on the bearing points 21 is particularly easy. In fact, the bearing zones which correspond to the heads of the piles 2 can be fairly wide since the positioning of the platform in the horizontal direction does not normally call for any special precision.

The very accurate vertical positioning of the platform is not liable to be disturbed during the remainder of the operations. In fact, the resistance of the anchoring flanges 32 within the massive block of concrete 5 prevents uplift and displacement of the platform.

If the need arises, the invention permits ready compliance with particular conditions for providing a connection between the superstructure and the foundations, for example by means of anchoring cramps which are welded beforehand to the plate 31 or projecting bracing members for positioning and anchoring the remaining structure to be built.

In the particular embodiment of FIG. 6, the platform 3 comprises by way of example complementary bracing beams 35 located at right angles to the beams 34 which have already been described. The beams 35 have high inertia in the central zone of the platform 3. The bottom flange 36 completes the means 32 for anchoring the platform in the concrete block 5. The system of bracing beams 34, 35 and flanges 32, 36 also serves as anchoring means for forming a veritable reinforced concrete raft which has particularly high strength, especially in the central portion thereof. In said reinforced concrete raft, the top layer of reinforcements is represented by the plate 31 whilst the bottom layer is represented by the flanges 32, 36 of the bracing beams 34, 35, the webs of said beams being intended to perform the function of stirrup-pieces for accommodating shear stresses. In order to afford stress resistance, said raft must be given a sufficient thickness and this governs the height of the bracing beams 34, 35. For the sake of enhanced clarity, only one beam 35 is shown in the figure.

The device of FIG. 6 is advantageous in the case of a heavy structure with a base having a small area such as certain types of bridge piers or a lighthouse tower 49 which calls for good distribution of the concentrated stresses which they apply on the platform 3.

In the type of foundation which is illustrated in FIG. 6, the space between the side 33 of the platform and the underwater bed 1 has been packed with a fill 41 which extends over a substantial radius around the platform and rises to the level of the seating plate 31. This arrangement can be employed in particular for the purpose of protecting the foundations against undermining of the ground around the periphery of the concrete block 5. In the event of violent action of currents or of the sea, the protective fill 41 can consist of heavy rock-fill material.

Figure 7:
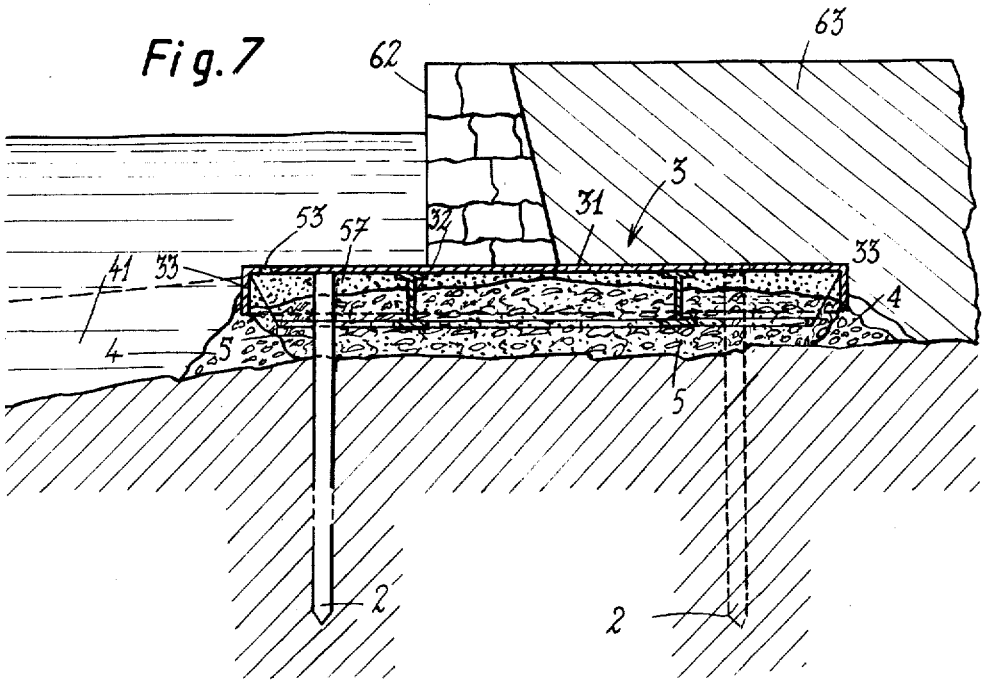
FIG. 7 is a diagrammatic sectional view showing the application of the invention to the construction of a quay wall.

FIG. 7 shows another alternative embodiment of the method of foundation construction in accordance with the invention in the case of a quay wall 62.

The platform 3 is supported by piles 2, the positioning and filling of said platform being carried out under the conditions which have already been described. The quay wall 62 is then constructed by a known method such as stacking of precast blocks which are placed in position by means of a floating shear-legs and the esplanade or quay level 63 behind the wall is the result of a backfilling operation. Once the structure is completed, the space 41 could be filled with progressively heavier and coarser rock material if this precaution is made necessary by rough seas. The platform 3 is purposely larger than the base of the quay wall which is located in a position such that the resultant of the vertical stresses arising from the weight of the wall masonry and of the filling material of lighter weight which are placed behind the wall passes through the center of gravity of said platform. The projection of the platform 3 on the side which extends underwater protects the sea bed against any undermining or scouring action which could result in particular from turbulence of the water which is produced by the propellers of boats as they draw alongside the quay. The projection of the platform on the land side also serves a useful purpose. It is in fact known that, if the coefficient of friction of the filling materials of the quay level 63 is of low value, the entire structure would be liable to collapse if no provision were made for a platform since the surface of failure is a cylinder of revolution having a horizontal axis. The overwidth of the platform 3 beneath the filling material of the quay level 63 will therefore be greater as said filling material is of poorer quality.

Many other types of structures can advantageously be built on the platforms in accordance with the invention.

Figure 8:
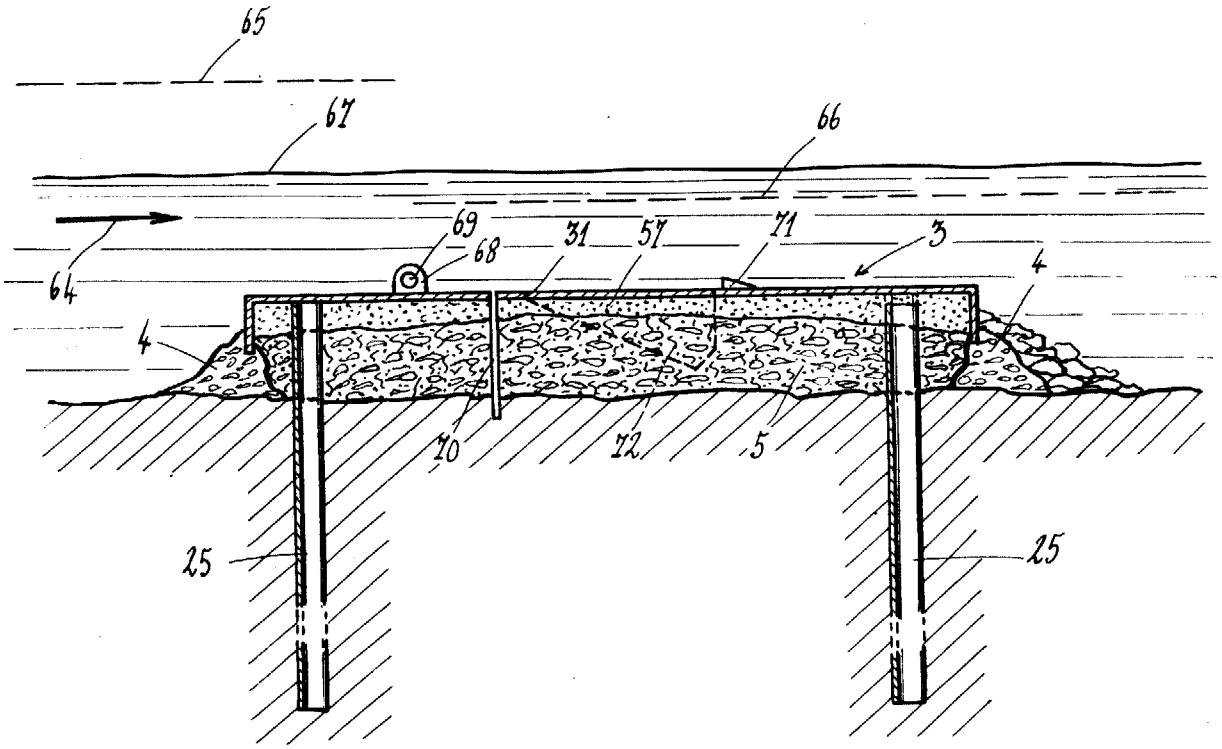
FIG. 8 is a sectional view showing another form of construction in accordance with the invention.

FIG. 8 relates to the construction of the foundation for a movable dam built across a watercourse, the direction of flow of which is shown by the arrow 64.

It is advantageous in this case to apply the cover against two sheet-pile walls 25 which are parallel to each other and driven-down transversely to the watercourse. As has already been mentioned, the heads of only a few sheet piles will be located exactly at the depth which has been chosen whilst the others are driven-down to a slightly greater depth for reasons of economy. Subsequent water levels both on the upstream and downstream side of the structure are indicated respectively at 65 and 66 and it is clearly important to prevent the upstream pressure from being fully applied beneath the foundation raft structure. In order to obtain this result, the upstream sheet-pile wall 25 is made less permeable than the downstream sheet-pile wall 25, for example by welding the constituent elements of said wall in pairs. Said downstream wall is useful in the event of undermining behind the structure.

There is also shown at 70 one of the vents constituted by tubes which pass through apertures of the platform 3 and which are driven into the permeable underwater bed prior to placing of the concrete 5. The movable shutter device of the dam is assumed to consist of a single element or of a plurality of juxtaposed elements which are not shown in the figures and are pivoted about the axes 69 of lugs 68 which are accurately located in alignment with each other on the top face of the platform 3. In the open position, said elements are folded-back against the platform 3 and the tubes 70 are therefore located downstream of the shutter device. Said tubes may be filled if necessary with materials of increasing size from the bottom upwards in order to constitute a filter for retaining the subjacent materials which are liable to be carried away by a light upward flow. For the sake of enhanced simplicity of the figure, the shutter props and anchoring members have not been illustrated; however, the reference 71 designates the projecting stops which are intended to serve as supports for the movable shutter device when this latter is in the raised position and the reference 72 designates pits which can accommodate operating jacks.

The movable shutter device can also be installed on the platform 3 in the dry prior to sinking of this latter. Erection of the final structure would accordingly be completed when lowering the platform underwater and carrying out the operation which consists in filling this latter.

The construction of the platform which takes place before this latter is transported to the site and lowered underwater can advantageously be carried out in a naval dockyard, shipbuilding yard or river construction site. If the dimensions of the platform are too large, the platform or the cover is subdivided into a number of elements which are subsequently shore either on the bank or shor or after flotation of said elements prior to immersion and sinking of the assembly formed by said elements. A construction of substantial length can also rest on juxtaposed platforms which are constructed independently with respect to each other.

It is readily apparent that the invention is not limited to the forms of construction and embodiments which have been described in the foregoing by way of non-limitative example and that many alternative forms can be contemplated without thereby departing either from the scope or the spirit of the invention.

I claim:

1. A method for building immersed foundations on a prepared bed without preliminary unwatering by means of a platform which has on its underface downwardly extending anchoring means and which serves as a cover for the concrete employed in the construction of the foundation and which defines a seating surface for the final structure, comprising positioning in the underwater bed a support constituted by at least three bearing points which project from said bed;

adjusting the height of the bearing points as a function of the depth selected for the seating plane;

lowering said platform underwater so as to rest on the bearing points;

enclosing the space between the foundation bed and the platform;

pouring a plastic material which is capable of setting and hardening into the said enclosed space in sufficient quantity to ensure that said platform anchoring means are imprisoned therein, without reaching the underface of the platform;

and then, after a sufficient time for the plastic material to set and harden, so that it constitutes with the platform a rigid and leaktight hollow body, filling the said hollow body with material in the plastic state, capable of setting and hardening.

2. A method according to claim 1, in which said support is constituted by elongated elements driven down to the requisite depths.

3. A method as claimed in claim 1, in which said enclosing of said space is performed between the foundation bed and the periphery of the platform by means of an embankment.

4. A method as claimed in claim 1, and introducing said plastic material into said rigid and leaktight hollow body by injection under pressure.

5. Combined means for the construction of immersed foundations, comprising a support having at least three bearing points of adjustable height relative to a foundation bed;

a platform which rests on said bearing support and has on its undersurface anchoring means projecting downwardly of a lesser quantity than said bearing points;

means to enclose the space between the foundation bed and the periphery of the platform; and means for pouring hardenable material such as concrete between the platform and the bed in order to embed the anchoring means in the hardenable material.

6. Combined means as claimed in claim 5, said support comprising elongated elements.

7. Combined means as claimed in claim 5, said platform comprising bracing elements to comprise a reinforced concrete raft.

8. Combined means as claimed in claim 7, said anchoring means comprising elements for bracing said platform.

9. Combined means as claimed in claim 5, and means to introduce concrete or mortar grout between the platform and the hardened mass after solidification of the hardenable material.

10. Combined means as claimed in claim 5, said platform comprising a substantially leaktight surface having pluggable passages for the hardenable material and pluggable discharge apertures for water and air.

11. Combined means as claimed in claim 9, and means for inserting said concrete or mortar grout under pressure.

12. Combined means as claimed in claim 5, at least some of said bearing points being comprised by sheet piles which project from a sheet pile wall.

13. Combined means as claimed in claim 5, said means for enclosing the space between the foundation bed and the periphery of the platform comprising an embankment.

14. Combined means as claimed in claim 5, said platform having a downwardly extending side along part of its periphery.

15. Combined means as claimed in claim 5, and means dividing said platform into compartments.

16. Combined means as claimed in claim 5, said platform comprising means for discharging water which is present beneath said platform.

17. Combined means as claimed in claim 5, said platform comprising a plurality of sections which are prefabricated for assembly on a construction site.

* * * * *

UNITED STATES PATENT AND TRADEMARK OFFICE

CERTIFICATE OF CORRECTION

PATENT NO. : 3,938,342

DATED : February 17, 1976

INVENTOR(S) : Jean AUBERT

It is certified that error appears in the above-identified patent and that said Letters Patent are hereby corrected as shown below:

In the caption of the patent, insert reference to the claimed priority as follows:

[30] Foreign Application Priority Data
June 22, 1972 France ..... 72 22.584

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*